United States Patent [19]

Reifenhäuser

[11] Patent Number: 4,851,179

[45] Date of Patent: Jul. 25, 1989

[54] METHOD OF OPERATING A FLEECE-MAKING APPARATUS

[75] Inventor: Hans Reifenhäuser, Troisdorf, Fed. Rep. of Germany

[73] Assignee: Reifenhauser GmbH & Co. Maschinenfabrik, Troisdorf, Fed. Rep. of Germany

[21] Appl. No.: 126,415

[22] Filed: Nov. 25, 1987

[30] Foreign Application Priority Data

Apr. 25, 1987 [DE] Fed. Rep. of Germany ..... 3713859

[51] Int. Cl.[4] ..... D01D 5/12

[52] U.S. Cl. ..... 264/555; 264/40.3; 264/210.8; 156/167; 425/66

[58] Field of Search ..... 264/40.3, 210.8, 518, 264/555; 156/167; 425/80.1, 83.1, 66

[56] References Cited

U.S. PATENT DOCUMENTS

| | | | |
|---|---|---|---|
| 2,881,471 | 4/1959 | Snow et al. | 425/83.1 |
| 3,707,593 | 12/1972 | Fukada et al. | 425/83.1 |
| 3,787,195 | 1/1974 | Kirchheim | 264/176 |
| 3,802,817 | 4/1974 | Matsuki et al. | 425/66 |
| 3,812,553 | 5/1974 | Marshall et al. | 425/80 |
| 4,017,580 | 4/1977 | Barbey | 264/210 F |
| 4,141,772 | 2/1979 | Buell | 264/113 |
| 4,217,078 | 8/1980 | Buell | 425/81.1 |
| 4,318,676 | 3/1982 | Gerking et al. | 425/72 S |
| 4,340,563 | 7/1982 | Appel et al. | 264/210.8 |
| 4,388,056 | 6/1983 | Lee et al. | 425/83.1 |
| 4,442,062 | 4/1984 | Fujii et al. | 264/518 |
| 4,684,416 | 8/1972 | Lenk | 425/72 |
| 4,692,106 | 9/1987 | Grabowski et al. | 425/66 |

FOREIGN PATENT DOCUMENTS

| | | |
|---|---|---|
| 2658518 | 6/1978 | Fed. Rep. of Germany . |
| 2906618 | 8/1980 | Fed. Rep. of Germany . |
| 4750003 | 12/1972 | Japan . |
| 5107204 | 3/1976 | Japan . |

*Primary Examiner*—Jan H. Silbaugh
*Assistant Examiner*—Allan R. Kuhns
*Attorney, Agent, or Firm*—Herbert Dubno

[57] ABSTRACT

The fleece-making apparatus includes a spinning nozzle system, a cooling shaft, a stretching aperture, a diffuser shaft, a fleece delivery conveyor and a device for feeding process air and for drawing outflowing air through the fleece delivery conveyor. The process air is divided into two partial flows as it is fed into the cooling shaft on each side of the cooling shaft. The upper partial flow serves for intensive cooling, the lower partial flow for additional cooling. Both partial flows are united in the cooling shaft. The cross section of the united process air flow is constricted by air control flaps positioned wedge like on opposite sides at the entrance of the stretching aperture. The process air flow issuing from the stretching aperture is influenced by pivoting wings movable about a horizontal axis at the entrance to the diffuser shaft on both sides and also by an adjustable damper which is located either above and/or below the fleece delivery conveyor.

2 Claims, 1 Drawing Sheet

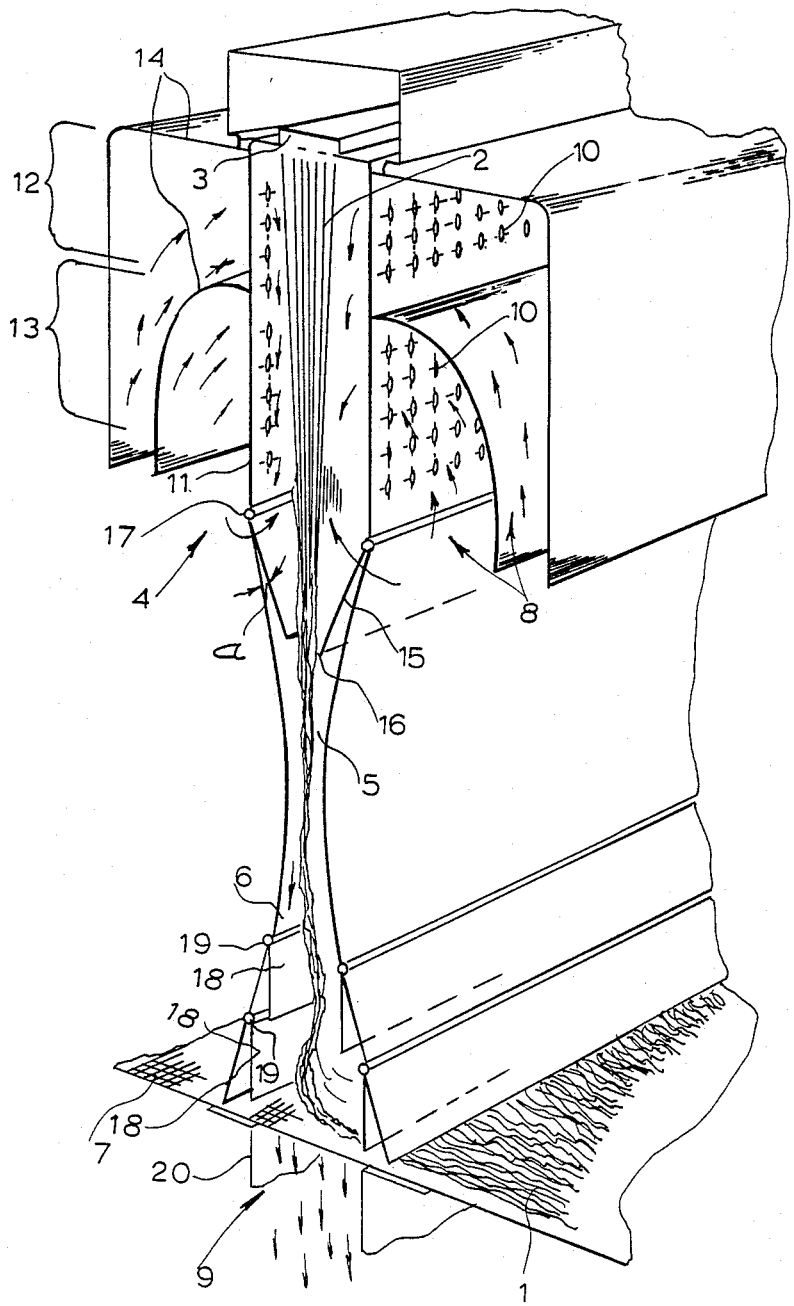
14
12
3
2
10
13
10
11
17
4
a
8
15
16
5
6
19
18
18
19
18
7
20
9
1

METHOD OF OPERATING A FLEECE-MAKING APPARATUS

CROSS REFERENCE TO RELATED APPLICATIONS

This application is related to the commonly owned copending applications Ser. No. 07/119,399; 07/119,398; 07/119,400, now U.S. Pat. No. 4,820,459; 07/119,469; 07/119,197, now U.S. Pat. No. 4,812,112 and 07/119,141, now U.S. Pat. No. 4,820,142 all filed on Nov. 10, 1987 and Ser. No. 07/124,255, now U.S. Pat. No. 4,813,864 filed on Nov. 23, 1987.

FIELD OF THE INVENTION

My invention relates to a method of operating a fleece-making apparatus used to make a spun-filament fleece from synthetic resin continuously-produced filament.

BACKGROUND OF THE INVENTION

An apparatus or fleece-making apparatus for making a spun-filament fleece from a synthetic resin continuously-produced filament is known comprising a spinning nozzle system (spinneret), a cooling shaft, a stretching aperture, a diffuser shaft, a fleece delivery conveyor and a device for feeding process air and for drawing outflowing air through the fleece delivery conveyor. The cooling shaft has a shaft wall provided with a plurality of air orifices and process air required for cooling is fed in through the air orifices to provide an air flow. In this apparatus the stretching aperture can be adjustable with regard to its size or can be of a fixed size. The undivided band of continuously-produced filaments is spun out of a single spinning nozzle system or spinneret or staggered groups of spinning nozzles or spinnerets.

The above described fleece-making apparatus are known in practice. They are set up and adjusted for making special products. The product parameters can be influenced with appropriate devices by adjustment of the stretching aperture and by adjustment of the flow of input thermoplastic material and/or process air. They are however not variable with a constant flow rate of thermoplastic material and process air without further effort. Consequently the change to another product is possible only with significant expense or effort. The process air allows no differential cooling of the continuously-produced filaments over the length of the cooling shaft.

OBJECTS OF THE INVENTION

It is an object of my invention to provide an improved method of operating a fleece-making apparatus which will avoid prior art drawbacks.

It is also an object of my invention to provide an improved method of operating a fleece-making apparatus, especially a fleece-making apparatus for making a spun-filament fleece from an continuously-produced synthetic resin filament.

It is another object of my invention to provide an improved method of operating a fleece-making apparatus, especially a fleece-making apparatus for making a spun-filament fleece from an continuously-produced synthetic resin filament, in which the product parameters are controlled within limits and also a changeover to another product can be easily accomplished.

SUMMARY OF THE INVENTION

These objects and others which will become more readily apparent hereinafter are attained in accordance with my invention in a method of operating a fleece-making apparatus for making a spun-filament fleece from an continuously-produced synthetic resin filament having a spinning nozzle system, a cooling shaft, a stretching aperture, a diffuser shaft, a fleece delivery conveyor and a device for feeding process air and for drawing outflowing air through the fleece delivery conveyor. The cooling shaft has a shaft wall provided with a plurality of air orifices and process air required for cooling is introduced through the air orifices to provide an air flow.

According to my invention for purposes of adjustment of the product parameters of the spun-filament fleece and for changing to another spun-filament fleece product, the process air fed into or introduced to the cooling shaft is divided into two partial flows on each side of the cooling shaft, and of course into an upper process air partial flow for an intensive cooling as well as a lower process air partial flow for an additional cooling.

Both of the partial flows are united in the cooling shaft and the cross section of the process air flow issuing united from the cooling shaft is constricted in a wedge configuration by a plurality of wedgelike air control flaps located in both sides at the entrance of the stretching aperture.

The process air flow issuing from the stretching aperture is influenced at the entrance of the diffuser shaft on both sides by a plurality of pivoting wings each movable about a horizontal axis and by an adjustable damper located below and/or above the fleece delivery conveyor with which the width of the outflowing air flow measured in the transport direction is adjustable.

In an advantageous method step of my invention the flow cross section of both of the partial flows is variable.

To attain very uniform product parameters over the entire width of the manufactured spun-filament fleece the process air flow is constrictable differently over the length of the stretching aperture measured transverse to the running direction of the continuously-produced synthetic resin filaments.

The product parameters can also be influenced when the process air flow at the entrance of the diffuser shaft is affected by a plurality of differently adjustable pivoting wings positioned over each other.

With the method according to my invention a fleece-making apparatus can be operated so that a spun-filament fleece is produced which is characterized by very uniform physical properties and quality over its entire width and length.

Moreover a change to another fleece product is possible in a simple way so that that product is also characterized by very uniform physical properties and qualities.

In the process according to my invention only a single air flow is required. Its entire flow rate is divided between an intensive cooling region and an additional cooling region.

In the intensive cooling region the necessary air flow can be fed in with the maximum possible air speed. In this way disturbing turbulence and filament clogging can be avoided.

Any additional air which may be needed for the process air is fed in as additional cooling air.

By adjusting the air control flaps and/or the pivoting wings and/or the baffles or air flow dividing guiding walls differently over the entire fleece width inhomogeneities in the physical properties over the spun-filament fleece width may be avoided. Because of the steps of my method particularly the edge regions of the spun-filament fleece have the desired physical properties and quality. A very precise adjustment of the surface weight (weight of fleece gas unit area) is possible.

BRIEF DESCRIPTION OF THE DRAWING

The above and other objects, features and advantages of my invention will become more readily apparent from the following description, reference being made to the accompanying highly diagrammatic drawing in which the sole FIGURE is a perspective view in vertical section of an apparatus for making a spun-filament fleece according to my invention.

SPECIFIC DESCRIPTION

The unit or apparatus shown in the drawing produces a spun-filament fleece 1 made from continuously-produced synthetic resin filaments 2.

This unit comprises a spinning nozzle system 3, a cooling shaft 4, a stretching aperture 5, a diffuser shaft 6 and a fleece delivery conveyor 7.

In addition, devices 8, 9 for feeding process air and for drawing outgoing air through the fleece delivery conveyor 7 are provided.

The cooling shaft 4 has a shaft wall 11 provided with air orifices 10. The shaft wall 11 however can also be formed as a flow directing device in the form of a screen or grid. Process air required for cooling is introduced into the cooling shaft 4.

The cooling shaft 4 has an upper intensive cooling region 12 and a lower additional cooling region 13 as well as suitable air flow dividing guiding walls or baffles 14 connected to the outside of the shaft wall 11. The air flow dividing guiding walls 14 are of adjustable height and the height of the intensive cooling region 12 is adjustable because of or by that height adjustability.

Air control flaps 15, each opposing pair converging like a wedge in the motion direction of the continuously-produced synthetic resin filaments 2 and connected to the shaft wall 11 to define wedge-shape air constrictions, are connected in series with the stretching aperture 5.

These pairs of air control flaps 15 have an outlet gap 16 which opens to the stretching aperture 5. These air control flaps 15 each have an adjustable setting angle a and are each movable about another horizontal axis 17 as is indicated in the drawing by the curved arrows.

The arrangement is set forth so that the setting angles a and thus the width of the outlet gap 16 is adjustable differently over the entire length of the air control flaps 15. For this purpose appropriate adjusting elements such as servomotors can be provided.

The diffuser shaft 6 is provided with pivoting wings 18 defining the flow or passage cross section which are movable about one horizontal axis 19. Opposing pairs are positioned above each other in this configuration of the apparatus in several steps and are adjustable independently of each other. Also they can be set at different setting angles with suitable adjusting elements.

The device 9 for drawing outflowing air has an adjustable damper 20 above and/or below the fleece delivery conveyor 7 with which the width of the outflowing air flow measured in the transport direction of the fleece delivery conveyor 7 is adjustable. It can be operated with a closed or partially closed air flow for the process air and for the outflowing air.

In any case the apparatus according to my invention does not operate with three separate air flows but with a single process air flow which, as described, is divided into a partial flow of air for the intensive cooling region 12 and a partial air flow for the additional cooling region 13.

By the device for feeding process air I mean the shaft wall 11 with the air orifices 10, the baffles or flow dividing guiding walls 14 and other similar items as well as an air blower or pump (not shown).

I claim:

1. In a method of operating a fleece-making apparatus for making a spun-filament fleece from continuously-produced synthetic resin filaments having a spinning nozzle system, a cooling shaft, a stretching aperture, a diffuser shaft, a fleece delivery conveyor and a device for feeding process air and for drawing outflowing air through said fleece delivery conveyor, said cooling shaft having a shaft wall provided with a plurality of air orifices and said process air required for cooling being introduced through said air orifices to provide an air flow, the improvement wherein for purposes of adjustment of the product parameters of said spun-filament fleece and for changing to another one of said spun-filament fleeces said process air while being fed into said cooling shaft is divided into two partial flows on each side of said cooling shaft, and into an upper process air partial flow for an intensive cooling as well as a lower process air partial flow for an additional cooling, a flow cross section of both of said partial flows being variable, both of said upper and lower partial flows being united in said cooling shaft, and a cross section of the flow of said process air issuing united from said cooling shaft is constricted by a plurality of air control flaps differently adjustable over the length thereof and defining wedge-shaped gaps located on both sides at the entrance of said stretching aperture, said process air flow issuing from said stretching aperture is influenced at the entrance of said diffuser shaft on both sides by a plurality of pivoting wings movable about a horizontal axis and by an adjustable damper located below said fleece delivery conveyor with which the width of said outflowing air flow measured in the transport direction is adjustable, said process air flow being constricted differently over the length of said stretching aperture measured transverse to the running direction of said continuously-produced synthetic resin filaments with said plurality of air control flaps, and said process air flow at said entrance of said diffuser shaft being influenced by adjusting angular positions of a plurality of differently adjustable ones of said pivoting wings positioned over each other, thereby attaining very uniform product parameters, physical properties and quality over the entire width of the manufactured spun-filament fleece.

2. A process for making a spun fleece from endless synthetic resin filaments, comprising the steps of:

(a) spinning a multiplicity of endless synthetic resin filaments in a downwardly directed spinning nozzle system and having said filaments pass downwardly from said spinning nozzle system;

(b) passing said downwardly moving filaments through a cooling shaft below said spinning nozzle system and directing cooling air against said filaments in said shaft from opposite sides to cool said filaments;

(c) thereafter entraining the filaments with said air through a stretching aperture defined between converging walls at an entrance side of said aperture, thereby stretching said filaments;

(d) passing the stretched filaments through a downwardly diverging diffuser shaft below said stretching aperture;

(e) collecting the filaments below said diffuser shaft as a spun fleece layer on a fleece-collecting conveyor movable generally horizontally in a downstream direction away from said diffuser shaft, while drawing at least part of said air through said fleece-collecting conveyor;

(f) subdividing the cooling air fed into said cooling shaft into a pair of partial flows on opposite sides of said cooling shaft to form an intensive air flow in an upper intensive cooling zone of said cooling shaft and an additional air flow in a lower additional cooling zone, said air flows collectively forming the process air traversing said shafts and said aperture;

(g) controlling the height of said intensive cooling zone by variably shifting said partial flows along said cooling shaft;

(h) directing said process air into said aperture at said entrance side between a pair of adjustable flaps inclined inwardly toward one another in the direction of flow into said aperture;

(i) regulating a flow cross section of said diffuser shaft by adjusting angular positions of respective flaps in said diffuser shaft about respective horizontal axes;

(j) limiting a region of said conveyor through which said air is drawn in step (e) by adjustably shifting at least one damper located below said conveyor; and (k) varying the process airflow differently across the entire width of said filaments, including differently adjusting said flaps over the entire width of said filaments, thereby attaining very uniform product parameters, physical properties and quality over the entire width of the manufactured spun-filament fleece.

* * * * *